US006640959B1

(12) United States Patent
Haumann et al.

(10) Patent No.: US 6,640,959 B1
(45) Date of Patent: Nov. 4, 2003

(54) DRIVE FOR ESCALATORS OR MOVING SIDEWALKS

(75) Inventors: Karl-Wilhelm Haumann, Dortmund (DE); Wolfram Grossmann, Dortmund (DE)

(73) Assignee: O&K Antriebstechnik GmbH & Co. KG, Hattingen (DE)

( * ) Notice: Subject to any disclaimer, the term of this patent is extended or adjusted under 35 U.S.C. 154(b) by 4 days.

(21) Appl. No.: 10/111,579

(22) PCT Filed: Aug. 19, 2000

(86) PCT No.: PCT/EP00/08106

§ 371 (c)(1),
(2), (4) Date: Apr. 26, 2002

(87) PCT Pub. No.: WO01/32545

PCT Pub. Date: May 10, 2001

(30) Foreign Application Priority Data

Oct. 29, 1999 (DE) ..... 199 52 168

(51) Int. Cl.[7] ..... B66B 21/00
(52) U.S. Cl. ..... 198/331
(58) Field of Search ..... 198/331

(56) References Cited

U.S. PATENT DOCUMENTS 4,580,675 A * 4/1986 Boltrek ..... 198/331
4,775,044 A * 10/1988 Hofling ..... 198/330
6,247,575 B1 * 6/2001 Thiel ..... 198/330

FOREIGN PATENT DOCUMENTS

DE 35 26 905 2/1987

* cited by examiner

*Primary Examiner*—Joseph A. Dillon
(74) *Attorney, Agent, or Firm*—Collard & Roe, P.C.

(57) ABSTRACT

In connection with a drive for escalators or moving sidewalks that is mounted within the step or pallet belt and comprises a distributor gear with two output shafts, specifically one for the handrail and one for the step or pallet belt, whereby each output shaft is provided with a drive gear for driving the output shaft, as well as an assembly unit mounted between the drive shafts for the distributor gear, the latter comprising a least one electric motor, the goal is to improve such a drive by particularly simplifying its assembly and using components that are simpler with respect to their design and therefore less costly.

This is accomplished in that the electric motor (1), the planetary gear (2) and a drive step (9, 7, 8) linked with the power take-off of the planetary gear (2) for the direct drive of at least the drive gear (10) of the output shaft (12) for the step or pallet belt, are combined in one single assembly unit (3) that can be secured on the distributor gear.

8 Claims, 2 Drawing Sheets

DRIVE FOR ESCALATORS OR MOVING SIDEWALKS

CROSS REFERENCE TO RELATED APPLICATIONS

Applicants claim priority under 35 U.S.C. §119 of German Application No. 199 52 168.9 filed Oct. 29, 1999. Applicants also claim priority under 35 U.S.C. §120 of PCT/EP00/08106 filed Aug. 19, 2000. The international application under PCT article 21(2) was not published in English.

The invention relates to a drive for escalators or moving sidewalks that is mounted within the step or pallet belt and comprises a distributor gear with two output shafts, specifically one for the handrail and one for the step or tread belt, whereby each output shaft is provided with a drive gear for driving the shaft associated with it, as well as a drive unit that is mounted between the drive shafts for the distributor gear. The drive unit comprises at least one electric motor with a planetary gear.

Such a drive is known from DE 35 26 905 C2 of the applicant firm of the present application. Said known drive comprises a distributor gear with two output shafts on which a motor drive module is arranged. Via a multi-stage planetary gear, said module drives a toothed gear that is installed in a fixed manner in the distributor gear. Said toothed gear is actively connected with the toothed gears of the output shafts for the step belt and the handrail. The toothed drive gear is supported in the housing of the distributor gear, whereas the motor drive module is forming a separate unit and is actively connected with the toothed drive gear after the assembly work has been completed.

Based on the given dimensions with which the output shafts ate spaced in conjunction with escalators or moving sidewalks, and given the fact that the motor drive module is mounted between the output shafts, the transmission ratio achieved with such a design of the construction of the drive with the toothed gears, which are arranged fixed in the distributor gear, is only relatively low. The distributor gear itself thus contributes only little to achieving the required transmission ratio, so that a motor drive module is required that needs expenditure accordingly, in which the required translation or reduction ratio is made available to a large extent by the planetary gear. Furthermore, both the assembly of the distributor gear and the installation of the motor drive unit on the housing of the distributor gear require a relatively great amount of expenditure.

The problem of the invention is to improve a drive of the type specified above in such a way that in particular its assembly is simplified and components can be used that are simpler with respect to their construction and therefore less costly.

Said problem is solved according to the invention in connection with a drive of the type specified above in that the electric motor, the planetary gear, and a drive step linked with the power take-off of the planetary drive for directly driving at least the drive wheel of the output shaft for the step or pallet belt, are combined in one single assembly unit that can be secured on the distributor gear.

As opposed to the prior art as represented by DE 35 26 905 C2, thus the central drive for the distributor gear is no longer mounted in the distributor gear itself, but realized in the form of a drive step that is connected with the planetary gear, and forming one single assembly unit combining the electric motor and the planetary drive. Such a drive step may be designed in this connection as a reduction gear, so that reduction can be saved in the planetary gear itself, which reduces the expenditure required for the planetary gear. Furthermore, the assembly of the distributor gear itself is substantially simpler because it does not contain the actual driving elements. Moreover, the single assembly unit can be installed in a simpler manner because it needs to be flanged only to the housing of the distributor gear, or secured in some other way.

According to a first embodiment of the invention, provision is made that the driving gears of both output shafts each are designed in the form of a toothed gear, and that the drive step of the assembly unit drives both toothed gears.

As an alternative, it is possible also to make provision that the drive step is designed only for directly driving the drive wheel—the latter being realized in the form of a toothed gear—of the output shaft for the step or pallet belt; and that the output shaft for the handrail is connected with the output shaft for the step or pallet belt via a drive chain.

It is particularly preferred if provision is made that the drive step of the assembly unit is designed in the form of a geared step that comprises a pinion linked with the power output of the planetary gear, and at least one intermediate gear. In this way, it is possible in a simple way to accommodate an additional reduction outside of the planetary gear, but in the single assembly unit that is connected in a fixed manner with the planetary gear, so that step-down gearing in the planetary gear itself can be saved.

If both output shafts are equipped with toothed driving wheels, provision is naturally made in that case that the gear step comprises two intermediate gears that may be advantageously provided with different width dimensions.

For the purpose of providing the bearing of the one or more intermediate gears in the assembly unit in the simplest possible way, provision is advantageously made that at least one of the intermediate gears is supported on a journal pin that is connected with the housing of the assembly unit in a fixed manner.

Furthermore, in a manner that is known per se, provision can be advantageously made that two or more assembly units are arranged on the distributor gear in parallel with the output shafts. Such an embodiment, viewed by itself, is known from DE 35 26 905 C2, to which reference is made in this regard.

The invention is explained in greater detail in the following by way of example with the help of the drawing, in which.

Figure 1:
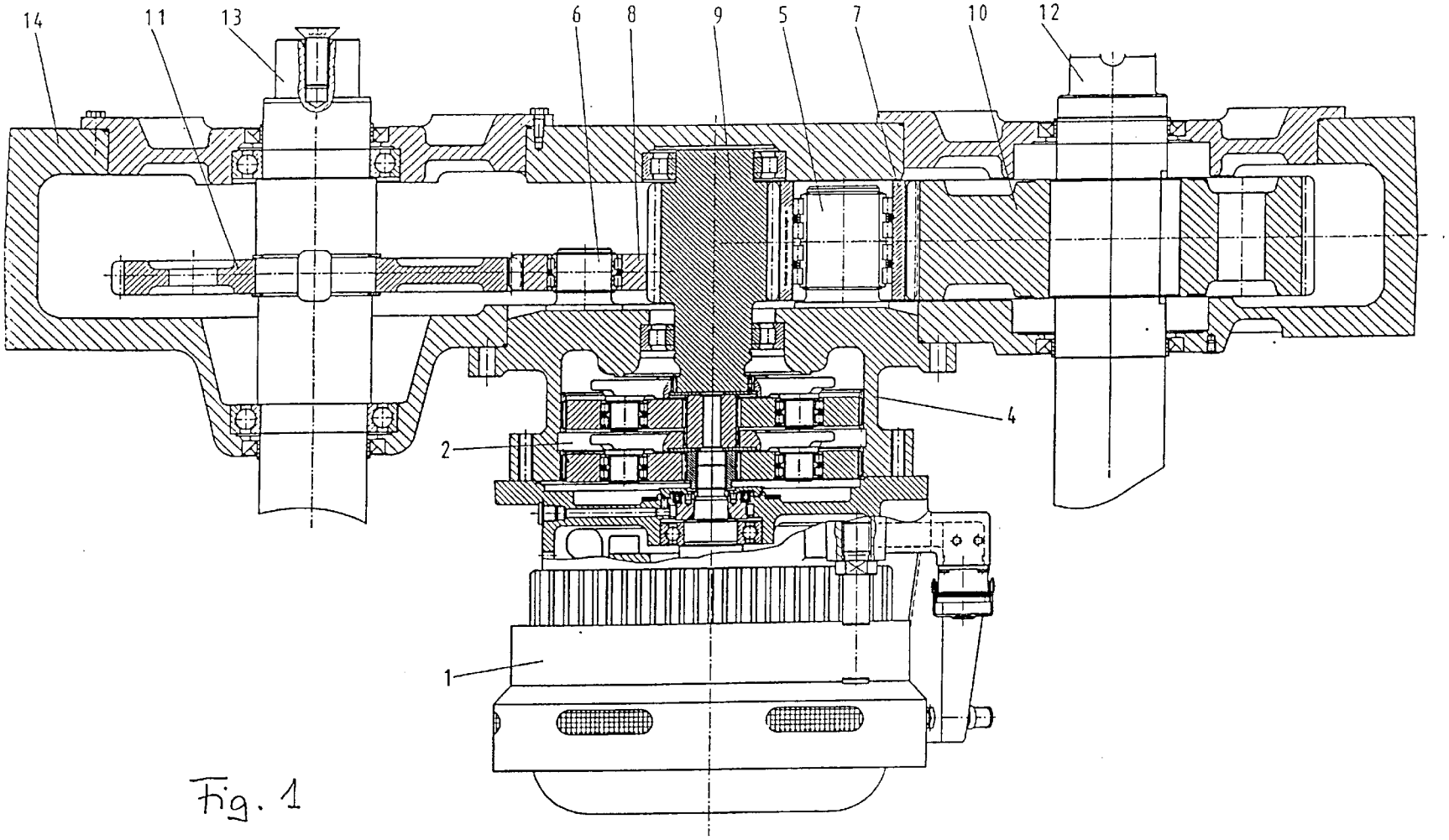
FIG. 1 shows a section through a drive as defined by the invention.

Of an escalator or moving sidewalk, the drawings only show an output shaft 12 for a step or pallet belt not shown, and an output shaft 13 for a handrail (not shown either) for an escalator or moving sidewalk. For driving the step or pallet belt and the handrail via said output shafts 12 and 13, provision is made according to the invention for a drive as defined by the invention that is mounted within the step or pallet belt (not shown) in a way basically known in connection with escalators or moving sidewalks, for example from DE 35 26 905 C2.

The output shafts 12 and 13 are components of a distributor gear. The housing of the latter is denoted by 14 and the output shafts 12 and 13 are supported in this housing. Furthermore, other components of the distributor gear are the toothed driving gears 10 and 11, which are connected with torsional strength with their associated output shafts 12 and 13, respectively.

For driving said distributor gear, provision is made for an assembly unit generally denoted by 3. Said assembly unit is comprised of an electric motor 1 with the planetary gear 2, as well as a drive step realized in the exemplified embodiment in the form of a geared step that is linked with the power take-off of the planetary gear 2. In the exemplified embodiment, said geared step comprises a pinion 9 linked with the output shaft of the planetary gear 2, as well as with the two intermediate gears 7 and 8. In the assembled state, the intermediate gear 10 mates with the toothed drive gear 10 of the output shaft 12, and the intermediate gear 8 mates with the toothed drive gear 11 of the output shaft 13. The intermediate gears 7 and 8 each are supported in a rotational manner on a pinion 5 and 6, respectively, which are arranged in a fixed manner on a housing 4 of the single assembly unit 3.

Figure 2:
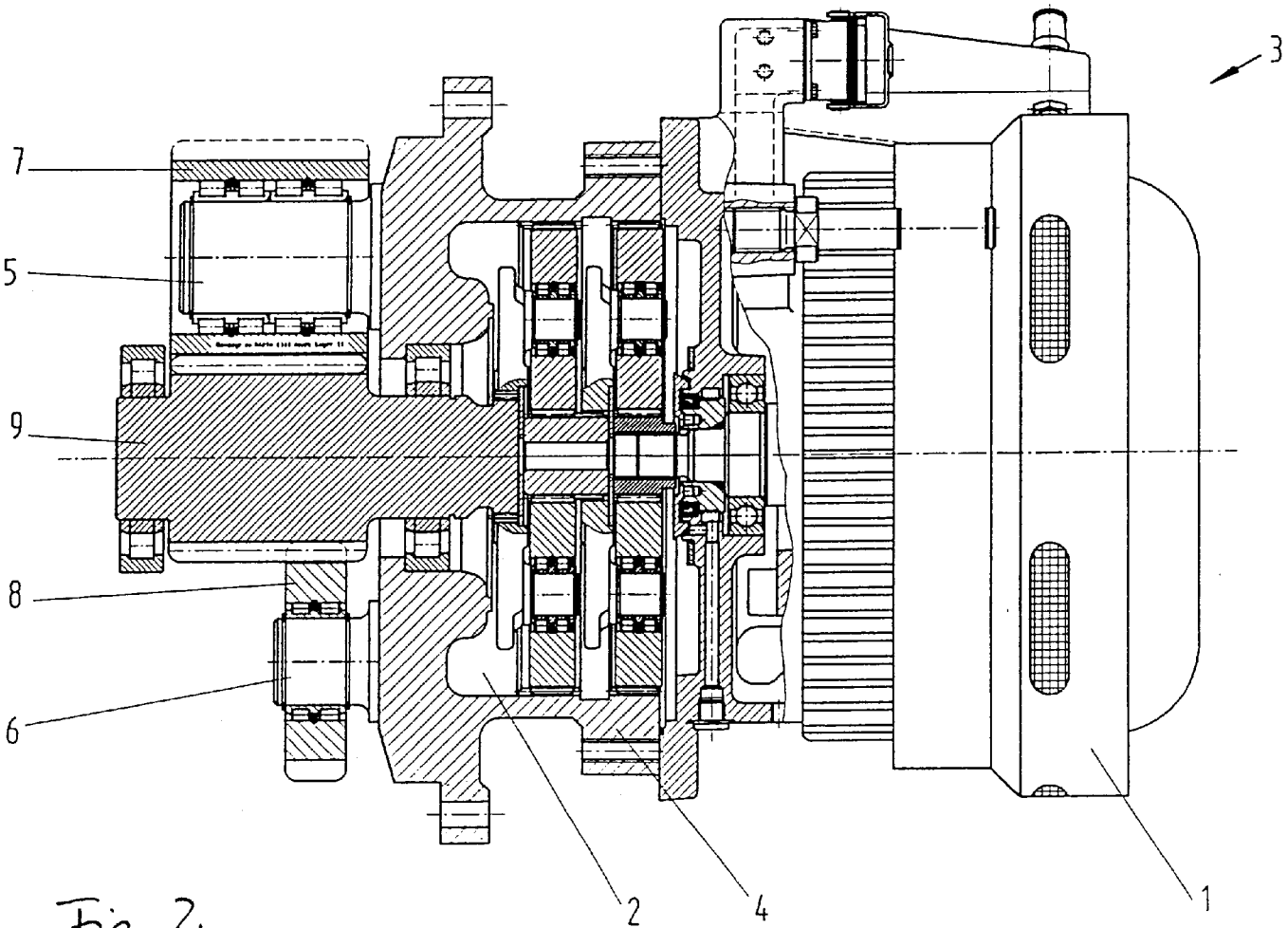
FIG. 2 is an enlarged sectional representation of the single assembly unit of the drive according to FIG. 1.

FIG. 2 shows the complete assembly unit 3 before it is installed on the housing 14 of the distributor gear. Said single assembly unit 3 can be flanged to the housing 14 of the distributor gear in a simple way. This is indicated by the reference numeral 15.

The transmission or reduction from the electric motor 1 thus takes place first via the planetary gear 2, and subsequently via the additional gear step 9, 7, 8 to the toothed drive gears 10 and, respectively 11 of the output shafts 12, 13.

As an alternative, it is possible also to make provision that the output shaft 13 is not driven via a toothed drive gear 11 and the intermediate gear 8, but by the output shaft 12 via a chain drive or the like, as it known—when viewed by itself—for example from DE 35 26 905 C2.

As it can be seen in the figures, the width of the intermediate gear 7 for the output shaft 12 of the step or pallet belt is preferably greater than the width of the other intermediate gear 8.

Moreover, provision can be made that two or more assembly units 3 are arranged on the distributor gear parallel with the output shafts 12, 13. This, however, is not shown in the figures.

What is claimed is:

1. A drive for escalators or moving sidewalks mounted within the step or pallet belt and comprising a distributor gear with two output shafts, specifically one for the handrail and one for the step or pallet belt, whereby each output shaft is provided with a drive gear for driving the associated output shaft it; as well as an assembly unit for the distributor gear mounted between the output shafts, said assembly unit having at least one electric motor, characterized in that the electric motor (1), a planetary gear (2) and a drive step comprising at least two gears (9, 7, 8) linked with the power take-off of the planetary gear, (2) for directly driving at least the drive gears (10) of the output shafts (12) for the step or pallet belt, are combined to form one said assembly unit (3) securing to the distributor gear.

2. The drive according to claim 1, characterized in that the drive gears (10, 11) of both output shafts (12, 13) each are realized in the form of a toothed gear; and that the drive step (9, 7, 8) of the assembly unit (3) directly drives both toothed gears.

3. The drive according to claim 1, characterized in that the drive step (9, 7) is designed for directly driving only the drive gear (11) of the output shaft (12) for the step or pallet belt, said drive gear being designed as a toothed gear; and that the output shaft (13) for the handrail is connected with the output shaft (12) for the step or pallet belt via a driving chain.

4. The drive according to claim 1, characterized in that the drive step of the assembly unit (3) is designed in the form of a geared step comprising a pinion (9) linked with the power take-off of the planetary gear (2), and at least one intermediate gear (7).

5. The drive according to claim 2, characterized in that the drive step comprises two intermediate gears (7, 8).

6. The drive according to claim 5, characterized in that the intermediate gears (7, 8) have different dimensions of width.

7. The drive according to claim 4, characterized in that the at least one intermediate gear (7, 8) is supported on a journal pin connected with the housing (4) of the assembly unit (3) in a fixed manner.

8. The drive according to claim 1, characterized in that two or more assembly units (3) are mounted on the distributor gear in parallel with the output shafts (12, 13).

* * * * *

UNITED STATES PATENT AND TRADEMARK OFFICE

CERTIFICATE OF CORRECTION

PATENT NO. : 6,640,959 B1
DATED : November 4, 2003
INVENTOR(S) : Haumann et al.

It is certified that error appears in the above-identified patent and that said Letters Patent is hereby corrected as shown below:

Column 4,
Line 7, after the word “shaft” please delete the word “it”.
Line 14, after the word “are” please insert -- unitarily -- and after the word “form” delete the word “one”.
Line 15, before the word “securing” please insert -- adapted for --.

Signed and Sealed this

Twenty-fifth Day of May, 2004

JON W. DUDAS
*Acting Director of the United States Patent and Trademark Office*